US007258158B2

(12) United States Patent
Kilinski et al.

(10) Patent No.: US 7,258,158 B2
(45) Date of Patent: Aug. 21, 2007

(54) INCREASING STABILITY OF SILICA-BEARING MATERIAL

(75) Inventors: Bart M. Kilinski, Montague, MI (US); Eliot S. Lassow, Muskegon, MI (US); William B. Carothers, Muskegon, MI (US)

(73) Assignee: Howmet Corporation, Whitehall, MI (US)

( * ) Notice: Subject to any disclaimer, the term of this patent is extended or adjusted under 35 U.S.C. 154(b) by 0 days.

(21) Appl. No.: 11/186,420

(22) Filed: Jul. 21, 2005

(65) Prior Publication Data

US 2006/0021732 A1 Feb. 2, 2006

Related U.S. Application Data

(60) Provisional application No. 60/591,949, filed on Jul. 28, 2004.

(51) Int. Cl.
*B22C 9/00* (2006.01)

(52) U.S. Cl. ..... 164/516; 164/517; 164/518; 164/519; 106/38.2; 106/38.3

(58) Field of Classification Search ..... 164/516, 164/517, 518, 519; 106/38.2, 38.3
See application file for complete search history.

(56) References Cited

U.S. PATENT DOCUMENTS

| | | | | |
|---|---|---|---|---|
| 2,932,864 | A | 4/1960 | Mellen, Jr. | 164/516 |
| 2,961,751 | A | 11/1960 | Operhall et al. | 164/519 |
| 3,196,506 | A | 7/1965 | Operhall et al. | 164/519 |
| 3,222,435 | A * | 12/1965 | Mellen, Jr. et al. | 264/28 |
| 3,683,996 | A | 8/1972 | Dunlop | 164/14 |
| 3,743,003 | A | 7/1973 | Brown | 164/16 |
| 4,057,227 | A * | 11/1977 | Cruff et al. | 366/2 |
| 4,093,017 | A * | 6/1978 | Miller et al. | 164/28 |
| 4,114,285 | A | 9/1978 | Cruff et al. | 34/487 |
| 4,121,942 | A * | 10/1978 | Kato | 106/617 |
| 4,966,225 | A | 10/1990 | Johnson et al. | 164/519 |
| 5,178,204 | A | 1/1993 | Kelly et al. | 164/468 |
| 5,297,615 | A | 3/1994 | Aimone et al. | 164/519 |
| 5,335,717 | A | 8/1994 | Chin et al. | 164/519 |
| 5,339,888 | A | 8/1994 | Tanner, Jr. | 164/516 |
| 5,766,329 | A | 6/1998 | LaSalle et al. | 106/38.9 |
| 5,787,958 | A | 8/1998 | Shivkumar et al. | 164/34 |
| 5,827,791 | A | 10/1998 | Pauliny et al. | 501/105 |
| 5,869,601 | A * | 2/1999 | Svoboda | 528/480 |
| 5,922,148 | A | 7/1999 | Irvine et al. | 148/555 |
| 5,975,188 | A | 11/1999 | Lassow et al. | 164/76.1 |
| 6,106,588 | A | 8/2000 | Skibo et al. | 75/684 |
| 6,299,822 | B1 * | 10/2001 | Yoon et al. | 264/621 |
| 6,311,760 | B1 | 11/2001 | Fernihough et al. | 164/122.1 |
| 6,640,877 | B2 | 11/2003 | Soderstrom et al. | 164/122.1 |
| 6,648,060 | B1 | 11/2003 | Yang | 164/519 |
| 6,749,006 | B1 * | 6/2004 | Yang et al. | 164/516 |

(Continued)

FOREIGN PATENT DOCUMENTS

| | | |
|---|---|---|
| EP | 0268841 | 6/1988 |

(Continued)

*Primary Examiner*—Kevin Kerns
*Assistant Examiner*—I.-H. Lin

(57) ABSTRACT

Method and apparatus for prolonging the stability (working life) of a ceramic slurry and other aqueous mixture or dispersion containing a liquid silica-bearing or other component as well as the raw liquid silica-bearing component in ambient air over time by providing a gas blanket that reduces exposure to ambient air.

13 Claims, 4 Drawing Sheets

U.S. PATENT DOCUMENTS

2002/0153644 A1 10/2002 Norville et al. ..... 266/237

FOREIGN PATENT DOCUMENTS

| | | |
|---|---|---|
| EP | 0715142 | 6/1996 |
| GB | 1557241 A | 12/1979 |
| JP | 200331333 | 11/2000 |
| WO | WO9832557 | 7/1998 |
| WO | WO98/45071 | 10/1998 |
| WO | WO9925511 | 5/1999 |

* cited by examiner

INCREASING STABILITY OF SILICA-BEARING MATERIAL

This application claims priority and benefits of U.S. provisional application Ser. No. 60/591,949 filed Jul. 28, 2004.

FIELD OF THE INVENTION

The present invention relates to method and apparatus for increasing stability of a ceramic slurry or other liquid material containing a liquid silica-bearing component that is adversely affected by exposure to ambient air over time.

BACKGROUND OF THE INVENTION

Both the investment casting process and the lost wax shell mold building process are well known, for example, as is apparent from the Operhall U.S. Pat. Nos. 3,196,506 and 2,961,751. The lost wax shell-mold building process involves repeatedly dipping a wax or other fugitive pattern of the article to be cast in ceramic slurry that is contained in a dip pot to provide a ceramic slurry layer on the pattern, draining excess slurry, stuccoing the slurry with coarse ceramic particles to provide a stucco layer on the slurry layer, and drying individual or multiple stuccoed slurry layers to build up a shell mold of desired wall thickness on the pattern. The green shell mold/pattern assembly then is subjected to a pattern removal operation to selectively remove the pattern from the shell mold. Following pattern removal, the green shell mold is fired at elevated temperature to develop mold strength for casting of molten metal or alloy therein.

The ceramic slurry typically is contained in a dip pot having an open upper end so that the pattern can be dipped by robot or manually into the slurry during the shell mold building process. Multiple dip pots typically are provided with each dip pot containing a different ceramic slurry to be applied to the pattern in the shell mold building process.

A common ceramic slurry includes a mixture of ceramic flour (powder), a basic colloidal silica as a liquid binder, and other ingredients to provide an aqueous slurry. When such a ceramic slurry is exposed to ambient air, the slurry is observed to destabilize over time as evidenced by premature gelling and change in viscosity of the slurry binder over time. Such gelling and viscosity changes over time adversely affect the suitability of the ceramic slurry for use in making investment shell molds, shortening the working life of the ceramic slurry.

SUMMARY OF THE INVENTION

The present invention involves method and apparatus for prolonging the working life of a ceramic slurry containing a basic silica-bearing liquid component and also the raw basic silica-bearing liquid material itself in ambient air over time. The present invention is also useful for prolonging the working life of other inorganic colloidal or aqueous solution binders or liquid materials containing them that are adversely affected by exposure to ambient air over time.

In an illustrative embodiment offered to illustrate but not limit the invention, a ceramic slurry comprises a mixture of ceramic powder, a basic silica-bearing liquid binder, and other additives and resides in an open pot or container. The ceramic slurry is covered with a gas blanket that reduces exposure of the ceramic slurry to ambient air. The gas blanket preferably comprises a gas other than air and that is substantially devoid of carbon dioxide. For purposes of illustration and not limitation, the gas blanket may be provided by discharging inert gas over the upper surface of the ceramic slurry and/or through the ceramic slurry at a suitable flow rate. Other illustrative embodiments involve subjecting an aqueous mixture or dispersion containing a basic silica-bearing liquid component or the raw silica-bearing liquid material to a gas blanket to this same end.

Advantages of the present invention will become more readily apparent from the following detailed description.

DETAILED DESCRIPTION OF THE INVENTION

Figure 1:
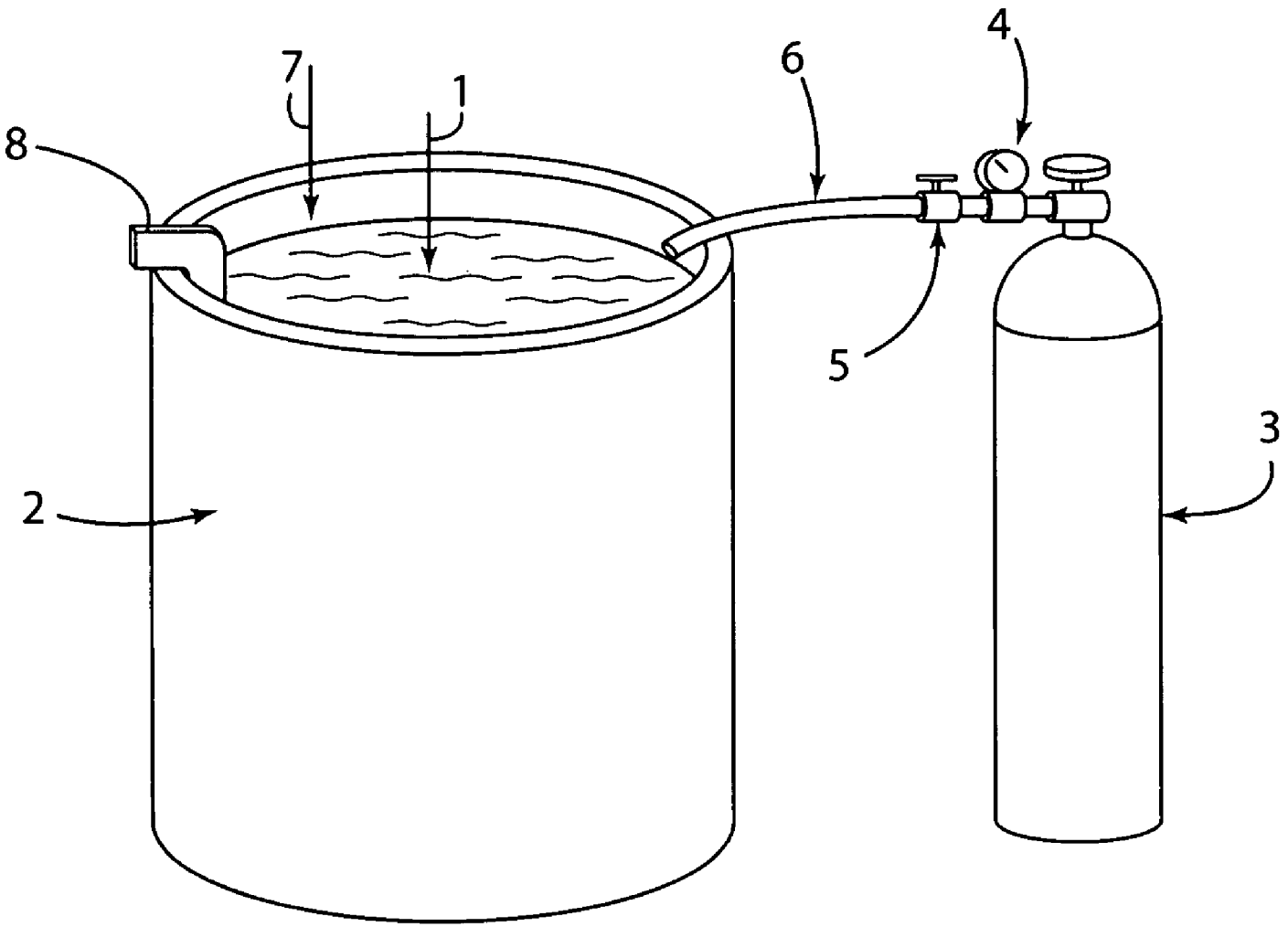
FIG. 1 is a schematic diagram of apparatus for practicing a method embodiment of the invention for prolonging the working life of a ceramic slurry in a dip pot used in the manufacture of investment shell molds.

In an illustrative embodiment offered to illustrate but not limit the invention, FIG. 1 shows a ceramic slurry 1 held in an open vessel or container 2 disposed in ambient air wherein the upper surface of the ceramic slurry 1 is subjected to or covered with a gas blanket that is effective to reduce exposure of the ceramic slurry to ambient air. The ceramic slurry 1 is of the type used in the well known lost wax ceramic shell mold building process to which the invention is applicable but not limited. In practice of the lost wax shell mold building process, a ceramic shell mold is formed by repeatedly dipping a fugitive pattern (not shown) of the article cast into the ceramic slurry which comprises a mixture of ceramic flour (powder), a basic silica ($SiO_2$)-bearing liquid binder, and other ingredients. A typical basic silica-bearing liquid binder employed as a slurry component comprises basic colloidal silica liquid binder (i.e. silica particles dispersed in water). Other basic silica-bearing liquid binders include, but are not limited to, conventional alkali silicate liquid binders such as, for example, sodium or potassium silicate aqueous solution binder. By basic silica-bearing liquid binder is meant a silica-bearing liquid binder having a pH of greater than 7. Typically, as is well known, the pattern is dipped in the ceramic slurry 1 and then excess slurry is drained off the pattern followed by stuccoing of the slurry layer on the pattern and drying of the stuccoed slurry layer in air or in a conventional drying apparatus. After drying, the fugitive pattern is subjected to similar dipping, draining, stuccoing and drying operations until the desired shell mold wall thickness is built up on the pattern. Drying of ceramic slurry/stucco layers is described in U.S. Pat. Nos. 2,932,864; 4,114,285; and 6,749,006, of common assignee herewith. The fugitive pattern can comprise a conventional wax, wax/polymer blends, polymeric or other fugitive materials molded or otherwise formed to the shape of the article to be cast as is well known in the art. Such fugitive patterns are removable from the green shell mold invested thereabout using conventional pattern removal techniques such as melting, leaching and/or vaporizing the pattern therefrom.

Typically, in practicing the lost wax process, one or more so-called prime coat (ceramic slurry) layers and prime coat stucco layers are applied on the fugitive pattern initially to provide a facecoat for contacting the molten metal or alloy to be cast in the shell mold. Then, the facecoated pattern is subjected to repeated steps of slurry dipping, draining, stuccoing and drying steps to form back-up slurry layer/stucco layers on the prime coat slurry layer(s) until the desired shell mold wall thickness is built-up. In general, the prime coat(s) employ(s) a finer refractory flour in the slurry than that present in the back-up slurries. The prime coat stucco similarly is a less coarse stucco than the back-up stucco. The prime coat slurry/stucco typically comprise a respective refractory material, such as a ceramic, to form a facecoat suitable for contacting the molten metal or alloy being cast without adverse reaction therewith. The back-up slurry and back-up stucco can comprise a refractory flour and refractory stucco which may be different or the same as those used for the prime coat slurry/stucco. The refractory flours/stuccoes used in the shell mold layers for casting nickel base and cobalt base superalloys typically comprise ceramic oxide flours/stucco as described in U.S. Pat. Nos. 4,966,225, 5,335,717, 5,975,188 and others, although refractory materials such as graphite, nitrides, carbides, and other materials may be used as described for example in U.S. Pat. No. 5,297,615, the teachings of all of these patents being incorporated herein by reference.

The invention is especially useful in prolonging the working life of the facecoat ceramic slurry or slurries employed in building the shell mold, although the invention is not limited to the facecoat slurries and can be used to prolong the working life of the back-up ceramic slurries employed in building the shell mold.

In FIG. 1, the ceramic slurry 1 is held in a conventional vessel or container 2, often called a dip pot, that includes means for stirring the ceramic slurry. For example, the dip pot may include an internal paddle or other stirrer to agitate the ceramic slurry 1, or the dip pot may be rotated about a vertical axis relative to a stationary stirrer 8 located in the dip pot to this same end.

An illustrative embodiment of the invention shown in FIG. 1 prolongs the working life of the ceramic slurry 1 in the dip pot 2 by providing a gas blanket designated 7 over the upper surface of the ceramic slurry 1 residing in the dip pot 2. The gas blanket 7 comprises a gas other than air that is substantially devoid of carbon dioxide. Such a gas blanket 7 provided over the ceramic slurry 1 reduces exposure of the ceramic slurry to ambient air and, in particular, to carbon dioxide in the air.

Referring to FIG. 1, the gas blanket 7 is provided over the ceramic slurry 1 by means of a conduit or pipe 6 that discharges a suitable gas over the ceramic slurry 1 in the dip pot 2. The conduit or pipe 6 is positioned so that its discharge end resides over the upper surface of the ceramic slurry 1. The conduit or pipe 6 is communicated to a source 3 of the gas, such as a conventional gas cylinder or shop gas, via a gas flow regulator 4 and needle valve 5 that is adjustable to set the flow rate of the gas discharged from the conduit 6 over the ceramic slurry to establish the gas blanket 7 effective to reduce exposure of the ceramic slurry to ambient air.

The gas blanket 7 comprises a gas that is substantially devoid of carbon dioxide. For purposes of illustration and not limitation, the gas blanket can comprise a gas which is selected from the group consisting of a noble and/or inert gas (e.g. He, Ne, Ar, Kr, Xe, Rn), nitrogen, oxygen, gaseous compounds (e.g. halocarbons), synthesized gas (e.g. $O_3$), and blends thereof, and which gas is substantially devoid (e.g. less than about 0.01 volume %) of carbon dioxide. An inert gas comprising argon is preferred for the gas blanket 7.

The gas blanket 7 is established effective to reduce exposure of the upper surface of the ceramic slurry 1 in dip pot 2 to ambient air, especially carbon dioxide in ambient air. Although not wishing to be bound any theory, Applicants believe that minor component(s) of air (e.g. carbon dioxide) is/are absorbed by and destabilize(s) the basic silica-bearing liquid binder (e.g. basic colloidal silica binder). Carbon dioxide pick-up destabilization is evidenced by premature gelling of the slurry and changing rheology of the slurry binder over time, rendering the slurry unsuitable for further use and requiring discarding of the unsuitable slurry. That is, such gelling and viscosity changes over time adversely affect the suitability of the slurry for use in making investment shell molds.

In practice of the invention, the gas blanket 7 alternately, or in addition, can be established over the ceramic slurry 1 in the dip pot 2 by bubbling argon or other suitable gas through the ceramic slurry 1 such that the gas exits the upper surface of the ceramic slurry to form the gas blanket thereon. For example, a gas bubbler (not shown) can be placed below the upper surface of the ceramic slurry in the dip pot 2 to this end to release argon or other gas into the ceramic slurry for movement upwardly through the slurry where the gas exits the upper surface to form the gas blanket on that surface.

Figure 3:
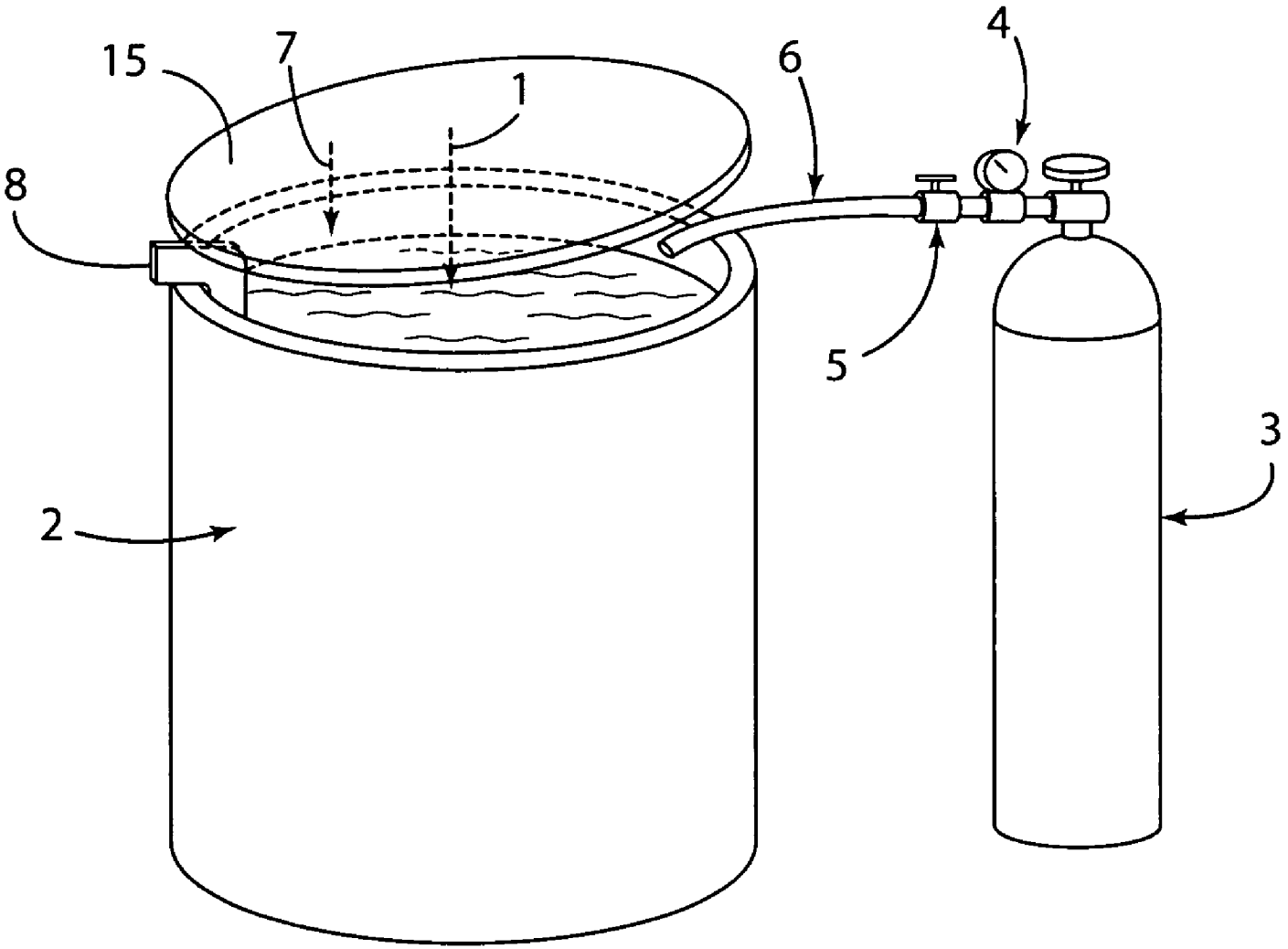
FIG. 3 is a schematic diagram of another method embodiment of the invention for prolonging the working life of a ceramic slurry in a dip pot used in the manufacture of investment shell molds.

The invention also envisions placing a cover 15, FIG. 3, at least partially overlying the upper surface of the ceramic slurry in the dip pot 1 to help confine the gas blanket 7 and also to reduce ambient air currents that might disrupt the protective gas blanket over the upper surface of the ceramic slurry.

Furthermore, the invention envisions providing a gettering agent (not shown) for carbon dioxide in a position in and/or above the ceramic slurry 1 in the dip pot 2 to preferentially getter carbon dioxide away from the slurry. The carbon dioxide may be that present in the ambient air and/or in the components of the slurry, such for example, carbon dioxide present in the water component of the slurry. To this end, the gettering agent will remove the carbon dioxide from the surrounding or ambient atmosphere, preventing its entrance into the ceramic slurry system.

The following Examples are offered to further illustrate the invention without limiting it.

EXAMPLES

Example 1

Two identical ceramic slurries were made for testing. Both ceramic slurries designated A and B comprised yttria flour (powder), colloidal silica liquid binder, a pH control agent and other conventional ingredients (e.g. antifoaming agent, surfactant, latex emulsion). Two 1-gallon high density polyproplylene, stirred, open pots were used to contain like amounts of slurry A and slurry B on a 24 hour/7 day per week basis with additions to the slurries only to make up for evaporation of water and control pH. The slurries were agitated in like manner in the 1-gallon open pots using a mixer located in each open pot. Efforts were made to keep the slurries in the 17-20 sec Zahn #4 viscosity cup range. A slow, continuous flow of argon gas was maintained on upper surface of slurry A. Slurry B was exposed to ambient air.

Each slurry was checked regularly for pH, viscosity, plate weight (3 inch square plate-1 minute drain), density and silica content. The plate weight measures wet film thickness. The starting silica content of both slurries A and B was 15%. by weight.

Figure 2:
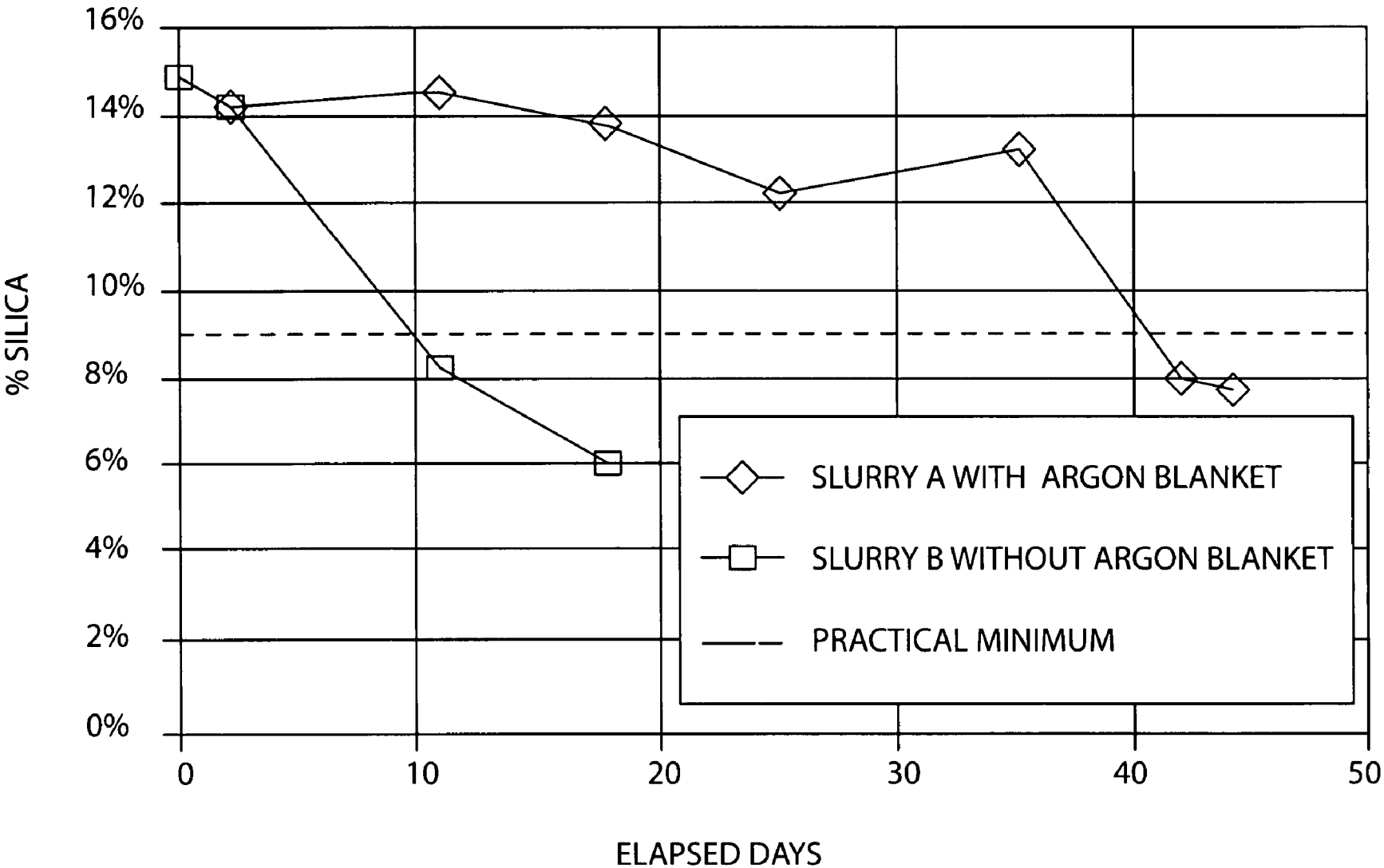
FIG. 2 is a graph of percent silica of slurries A and B versus elapsed days.

As shown in FIG. 2, the argon-blanketed slurry A was determined to exhibit suitable slurry properties (e.g. practical minimum silica content of 9% by weight) for about 41 days. In contrast, slurry B without argon blanket was determined to exhibit suitable properties for only about 10 days.

The test results establish that providing the argon blanket on a ceramic slurry held in an open pot in ambient air is very beneficial for extending the longevity of the ceramic slurry. That is, the working life of slurry A was substantially prolonged by practice of an embodiment of the present invention. Also, the use of the argon blanket reduced the need to add water and pH control agents to the slurries over time of testing. For example, the slurry A with an argon blanket needed about 50% less water and about 40-64% less pH control agent added during the testing.

Example 2

A ceramic slurry designated C comprised zircon flour (powder), cobalt aluminate flour, colloidal silica liquid binder, and other conventional ingredients (e.g. antifoaming agent, surfactant, latex emulsion). One 10-gallon rotating open-top slurry dip pot was used to contain an amount of slurry C in ambient air. Another 10-gallon rotating open-top slurry dip pot was used to contain a similar amount of identical slurry D with an argon blanket provided on the upper surface of the ceramic slurry. In particular, shop argon was introduced over the surface of slurry D at a flow rate of about 6 SCFM through a ¼ inch diameter rubber hose positioned over the slurry surface. The presence of the argon blanket was monitored by using an oxygen meter, with an oxygen level significantly below ambient targeted for the argon blanketed slurry. A pot lid or cover, FIG. 3, was propped in front of the pot to reduce air currents over the slurry, resulting in reduced measured oxygen levels of 6% by volume (ambient air nominally is 21% oxygen).

Plate weight, viscosity, and density of the slurry were monitored daily. Water additions were made once daily, except on weekends, to compensate for evaporative losses. The slurries in the dip pots were controlled to similar density and viscosity until they could not be kept within the useful range, at which time the slurries were adjusted as necessary by water and/or collidal silica, to remain within desired operating range for viscosity and plate weight.

The slurry C with the argon blanket could be maintained within desired operating range until day 70. In contrast, the slurry D without the argon blanket could be maintained within the desired operating range until only day 45. Use of the argon blanket thus resulted in an increase in working life of slurry C of 3.5 weeks, or 56% as compared to slurry D without the argon blanket.

Figure 4:
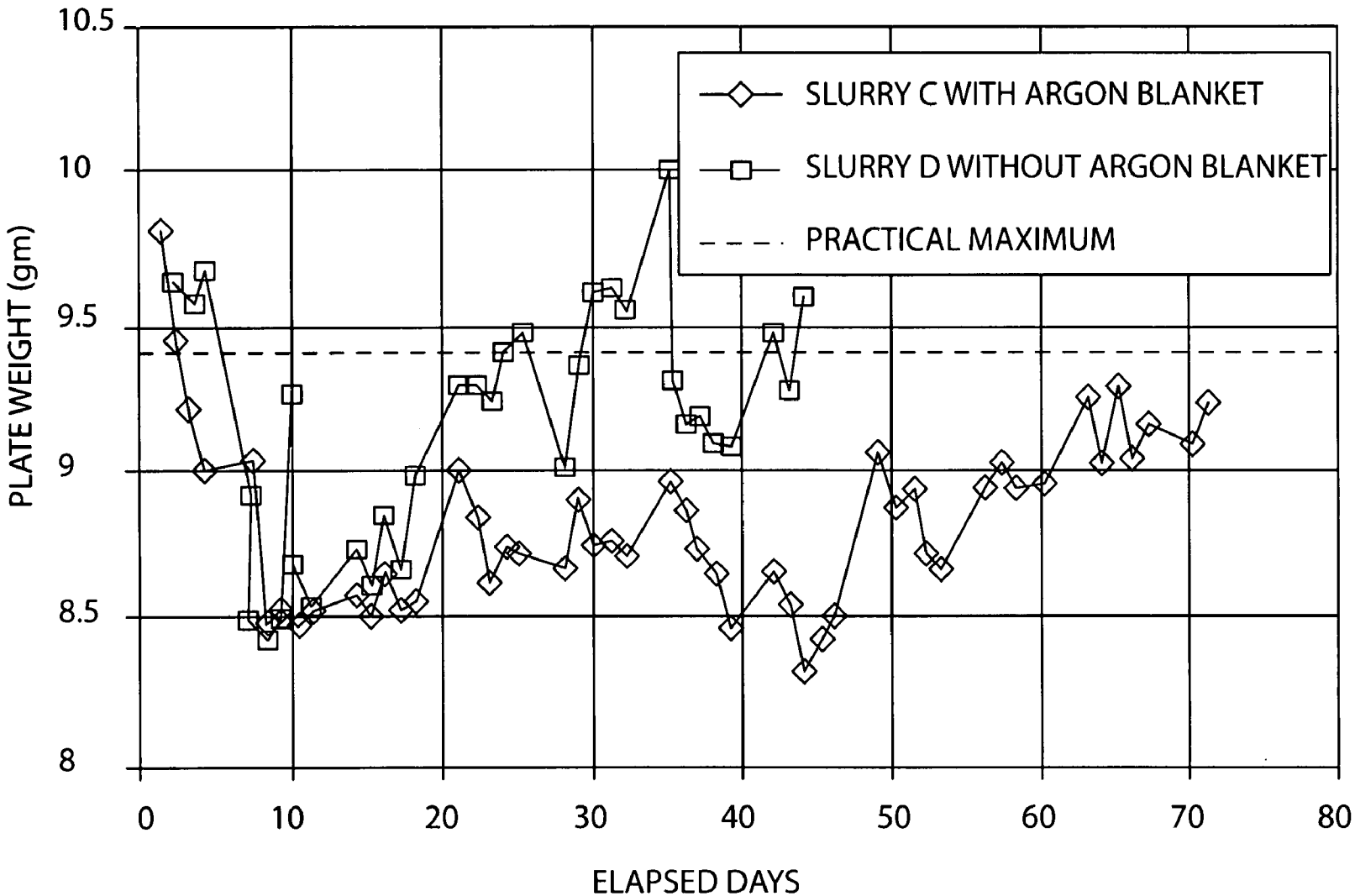
FIG. 4 is plate weight of slurries of C and D versus elapsed days.

FIG. 4 illustrates that the plate weight (6 inch square plate-3 minute drain) stayed below the desired practical maximum level considerably longer with slurry C than with slurry D at essentially identical viscosities.

The invention is not limited to practice with ceramic slurries for use in making investment shell molds as described above. The invention can be practiced with any aqueous mixture or solution or dispersion (e.g. colloid) that includes a basic silica-bearing liquid component, such mixture or dispersion including but not being limited to, paints, coatings, treatments, and slurries that include colloidal silica, alkali silicate solution, and other basic silica-bearing liquids. Moreover, the invention can be practiced to prolong the working life of the raw silica-bearing liquid material itself, including but not limited to, raw collodial silica and raw alkali silicate solution. The invention further envisions prolonging the working life of other inorganic colloidal binders or aqueous solution binders that are adversely affected by exposure to ambient air over time.

Although the present invention has been described with respect to certain specific illustrative embodiments thereof, it is not so limited and can be modified and changed within the spirit and scope of the invention as set forth in the appended claims.

We claim:

1. A method for prolonging the working life of a ceramic slurry comprising ceramic particulates suspended in a silica-bearing binder wherein the ceramic slurry is stored in an open or partially open container in ambient air over time, comprising providing a gas blanket comprising a gas other than air and that is substantially devoid of carbon dioxide over the ceramic slurry to reduce exposure of the ceramic slurry to ambient air and delay destabilization of the ceramic slurry.

2. The method of claim 1 wherein the gas blanket is selected from the group consisting of an inert gas, nitrogen, an oxygen.

3. The method of claim 2 wherein the inert gas comprises argon.

4. The method of claim 1 wherein the ceramic slurry resides in a container open to ambient air, and the gas blanket is provided over the top surface of the ceramic slurry.

5. The method of claim 4 wherein the container is a dip pot.

6. The method of claim 1 wherein the silica-bearing binder comprises colloidal silica or alkali silicate solution.

7. A method of for prolonging the working life of a liquid material containing a basic silica-bearing component that is adversely affected in air over time wherein the component is stored in an open or partially open container in ambient air overtime, comprising providing a gas blanket comprising a gas other than air and that is substantially devoid of carbon dioxide over the material to reduce exposure of the mixture material to ambient air and delay destabilization of the component.

8. The method of claim 7 wherein the gas blanket is selected from the group consisting of an inert gas, nitrogen, and oxygen.

9. The method of claim 7 wherein the component comprises a colloidal silica binder or alkali silicate aqueous solution binder.

10. A method of for prolonging the working life of a raw silica-bearing material wherein the material is stored in an open or partially open container in ambient air over time, comprising providing a gas blanket comprising a gas other than air and that is substantially devoid of carbon dioxide over the material to reduce exposure of the material to ambient air.

11. The method of claim 10 wherein the material is colloidal silica.

12. The method of claim 10 wherein the material is alkali silicate aqueous solution.

13. The method of claim 10 wherein the gas blanket is selected from the group consisting of an inert gas, nitrogen, and oxygen.

* * * * *